US008905320B2

(12) United States Patent
Jiang et al.

(10) Patent No.: US 8,905,320 B2
(45) Date of Patent: Dec. 9, 2014

(54) ROOM HEATING DEVICE CAPABLE OF SIMULTANEOUSLY PRODUCING SOUND WAVES

(75) Inventors: Kai-Li Jiang, Beijing (CN); Liang Liu, Beijing (CN); Chen Feng, Beijing (CN); Li Qian, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 1120 days.

(21) Appl. No.: 12/758,117

(22) Filed: Apr. 12, 2010

(65) Prior Publication Data

US 2010/0311002 A1 Dec. 9, 2010

(30) Foreign Application Priority Data

Jun. 9, 2009 (CN) ..... 2009 1 0108045

(51) Int. Cl.

| | |
|---|---|
| ***F24J 3/00*** | (2006.01) |
| ***F24H 3/00*** | (2006.01) |
| ***H04R 23/00*** | (2006.01) |

(52) U.S. Cl.

CPC ..... *F24H 3/002* (2013.01); *H04R 23/002* (2013.01); *F24H 2250/10* (2013.01)

USPC ..... 237/1 R; 381/164; 432/227

(58) Field of Classification Search

CPC .... F24H 3/002; F24H 2250/10; H04R 23/002

USPC ..... 237/1 R; 381/164; 432/227

See application file for complete search history.

(56) References Cited

U.S. PATENT DOCUMENTS

| | | | |
|---|---|---|---|
| 1,528,774 | A | 3/1925 | Kranz |
| 3,670,299 | A | 6/1972 | Kahn |
| 3,982,143 | A | 9/1976 | Tamura et al. |
| 4,002,897 | A | 1/1977 | Kleinman et al. |
| 4,045,695 | A | 8/1977 | Itagaki et al. |
| 4,334,321 | A | 6/1982 | Edelman |
| 4,503,564 | A | 3/1985 | Edelman et al. |
| 4,641,377 | A | 2/1987 | Rush et al. |
| 4,689,827 | A | 8/1987 | Gurney, Jr. |
| 4,766,607 | A | 8/1988 | Feldman |

(Continued)

FOREIGN PATENT DOCUMENTS

| | | |
|---|---|---|
| CN | 2083373 | 8/1991 |
| CN | 2251746 Y | 4/1997 |

(Continued)

OTHER PUBLICATIONS

Picco et al, WO 2008/139117 English machine translation, Nov. 20, 2008.*

(Continued)

*Primary Examiner* — Kang Hu
*Assistant Examiner* — Phillip E Decker
(74) *Attorney, Agent, or Firm* — Novak Druce Connolly Bove + Quigg LLP

(57) ABSTRACT

A room heating device includes a supporting body, a thermoacoustic element, a first electrode and a second electrode. The thermoacoustic element is disposed on the supporting body. The first electrode and the second electrode are connected to the thermoacoustic element. The first electrode is spaced apart from the second electrode.

17 Claims, 6 Drawing Sheets

(56) References Cited

U.S. PATENT DOCUMENTS

| | | | | |
|---|---|---|---|---|
| 5,694,477 | A | 12/1997 | Kole | |
| 6,307,300 | B1 | 10/2001 | Yamamoto et al. | |
| 6,473,625 | B1 | 10/2002 | Williams et al. | |
| 6,777,637 | B2 | 8/2004 | Nakayama et al. | |
| 6,803,116 | B2 | 10/2004 | Ikeda | |
| 6,803,840 | B2 | 10/2004 | Kowalcyk et al. | |
| 6,808,746 | B1 | 10/2004 | Dai et al. | |
| 6,864,668 | B1 | 3/2005 | McCune et al. | |
| 6,921,575 | B2 | 7/2005 | Horiuchi et al. | |
| 7,045,108 | B2 | 5/2006 | Jiang et al. | |
| 7,130,436 | B1 | 10/2006 | Tabata et al. | |
| 7,240,495 | B2 * | 7/2007 | Symko et al. | 62/6 |
| 7,242,250 | B2 | 7/2007 | Tsurumi | |
| 7,315,204 | B2 | 1/2008 | Seven | |
| 7,366,318 | B2 | 4/2008 | Nevill | |
| 7,393,428 | B2 * | 7/2008 | Huang et al. | 156/249 |
| 7,474,590 | B2 | 1/2009 | Watabe et al. | |
| 7,572,165 | B2 | 8/2009 | Liu et al. | |
| 7,723,684 | B1 | 5/2010 | Haddon et al. | |
| 7,799,163 | B1 | 9/2010 | Mau et al. | |
| 8,406,450 | B2 * | 3/2013 | Jiang et al. | 381/397 |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0152238 | A1 | 8/2003 | Daly | |
| 2003/0165249 | A1 | 9/2003 | Higuchi | |
| 2004/0053780 | A1 | 3/2004 | Jiang et al. | |
| 2004/0070326 | A1 | 4/2004 | Mao et al. | |
| 2004/0119062 | A1 | 6/2004 | Lu et al. | |
| 2005/0006801 | A1 | 1/2005 | Kinloch et al. | |
| 2005/0036905 | A1 | 2/2005 | Gokturk | |
| 2005/0040371 | A1 | 2/2005 | Watanabe et al. | |
| 2005/0129939 | A1 | 6/2005 | Shigematsu et al. | |
| 2005/0201575 | A1 | 9/2005 | Koshida et al. | |
| 2006/0072770 | A1 | 4/2006 | Miyazaki | |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa et al. | |
| 2007/0161263 | A1 | 7/2007 | Meisner | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 | 7/2008 | Zhang et al. | |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2008/0304201 | A1 | 12/2008 | Takao et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0108906 | A1 * | 4/2009 | Butler | 327/387 |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2009/0268557 | A1 | 10/2009 | Jiang et al. | |
| 2009/0268562 | A1 | 10/2009 | Jiang et al. | |
| 2009/0268563 | A1 * | 10/2009 | Jiang et al. | 367/140 |
| 2010/0054502 | A1 | 3/2010 | Miyachi | |
| 2010/0054507 | A1 | 3/2010 | Oh et al. | |
| 2010/0086166 | A1 | 4/2010 | Jiang et al. | |
| 2010/0166232 | A1 | 7/2010 | Liu et al. | |
| 2010/0233472 | A1 | 9/2010 | Liu et al. | |
| 2011/0171419 | A1 | 7/2011 | Li et al. | |

FOREIGN PATENT DOCUMENTS

| | | | |
|---|---|---|---|
| CN | 2282750 | Y | 5/1998 |
| CN | 2302622 | | 12/1998 |
| CN | 2327142 | | 6/1999 |
| CN | 1239394 | | 12/1999 |
| CN | 1265000 | | 8/2000 |
| CN | 2425468 | | 3/2001 |
| CN | 2485699 | Y | 4/2002 |
| CN | 1407392 | | 4/2003 |
| CN | 1443021 | | 9/2003 |
| CN | 1629627 | | 6/2005 |
| CN | 1691246 | | 11/2005 |
| CN | 1698400 | | 11/2005 |
| CN | 1698400 | A | 11/2005 |
| CN | 1711620 | A | 12/2005 |
| CN | 2779422 | Y | 5/2006 |
| CN | 1787696 | | 6/2006 |
| CN | 2787870 | | 6/2006 |
| CN | 2798479 | | 7/2006 |
| CN | 1821048 | | 8/2006 |
| CN | 1886820 | | 12/2006 |
| CN | 1944829 | | 4/2007 |
| CN | 1982209 | | 6/2007 |
| CN | 1997243 | | 7/2007 |
| CN | 101239712 | | 8/2008 |
| CN | 101284662 | | 10/2008 |
| CN | 201150134 | | 11/2008 |
| CN | 101314464 | | 12/2008 |
| CN | 101437663 | | 5/2009 |
| CN | 101458221 | A | 6/2009 |
| CN | 101471213 | | 7/2009 |
| CN | 101715155 | | 5/2010 |
| CN | 101400198 | | 9/2010 |
| DE | 102005059270 | | 6/2007 |
| JP | 49-24593 | | 3/1974 |
| JP | 58-9822 | | 1/1983 |
| JP | 58-19491 | | 2/1983 |
| JP | 60-22900 | | 2/1985 |
| JP | 61-294786 | | 12/1986 |
| JP | 1-255398 | | 10/1989 |
| JP | 3-147497 | | 6/1991 |
| JP | 4-126489 | | 4/1992 |
| JP | 6-33390 | | 4/1994 |
| JP | 7-282961 | | 10/1995 |
| JP | 8-20868 | | 1/1996 |
| JP | 9-105788 | | 4/1997 |
| JP | 11-282473 | | 10/1999 |
| JP | 11-300274 | | 11/1999 |
| JP | 2001333493 | | 11/2001 |
| JP | 2002-186097 | | 6/2002 |
| JP | 2002-352940 | | 12/2002 |
| JP | 2002346996 | | 12/2002 |
| JP | 2002542136 | | 12/2002 |
| JP | 2003500325 | | 1/2003 |
| JP | 2003-154312 | | 5/2003 |
| JP | 2003198281 | | 7/2003 |
| JP | 2003-266399 | | 9/2003 |
| JP | 2003-319490 | | 11/2003 |
| JP | 2003-319491 | | 11/2003 |
| JP | 2003-332266 | | 11/2003 |
| JP | 2003-343867 | | 12/2003 |
| JP | 20042103 | | 1/2004 |
| JP | 2004-107196 | | 4/2004 |
| JP | 2004229250 | | 8/2004 |
| JP | 2005-20315 | | 1/2005 |
| JP | 2005-51284 | | 2/2005 |
| JP | 2005-73197 | | 3/2005 |
| JP | 2005-97046 | | 4/2005 |
| JP | 2005189322 | | 7/2005 |
| JP | 2005-235672 | | 9/2005 |
| JP | 2005-318040 | | 11/2005 |
| JP | 2005-534515 | | 11/2005 |
| JP | 2005-341554 | | 12/2005 |
| JP | 2005333601 | | 12/2005 |
| JP | 2006-93932 | | 4/2006 |
| JP | 2006-180082 | | 7/2006 |
| JP | 2006-202770 | | 8/2006 |
| JP | 2006-217059 | | 8/2006 |

(56) References Cited

FOREIGN PATENT DOCUMENTS

| | | |
|---|---|---|
| JP | 2006270041 | 10/2006 |
| JP | 2007-24688 | 2/2007 |
| JP | 2007-54831 | 3/2007 |
| JP | 2007-167118 | 7/2007 |
| JP | 2007-174220 | 7/2007 |
| JP | 2007-187976 | 7/2007 |
| JP | 2007-196195 | 8/2007 |
| JP | 2007-228299 | 9/2007 |
| JP | 2007-527099 | 9/2007 |
| JP | 2008-62644 | 3/2008 |
| JP | 2008-101910 | 5/2008 |
| JP | 2008-153042 | 7/2008 |
| JP | 2008-163535 | 7/2008 |
| JP | 2008-167252 | 7/2008 |
| JP | 2008-269914 | 11/2008 |
| JP | 2009-31031 | 2/2009 |
| JP | 2009-91239 | 4/2009 |
| JP | 2009-94074 | 4/2009 |
| JP | 200994074 | 4/2009 |
| JP | 2009-146896 | 7/2009 |
| JP | 2009-146898 | 7/2009 |
| JP | 2009-164125 | 7/2009 |
| JP | 2009-184907 | 8/2009 |
| JP | 2009-184908 | 8/2009 |
| KR | 10-0761548 | 9/2007 |
| TW | 432780 | 5/2001 |
| TW | 568882 | 1/2004 |
| TW | 200603400 | 1/2006 |
| TW | I248253 | 1/2006 |
| TW | 200726290 | 7/2007 |
| TW | 200740976 | 11/2007 |
| TW | 200744399 | 12/2007 |
| TW | 200726300 | 2/2008 |
| TW | 200829675 | 7/2008 |
| TW | 200833862 | 8/2008 |
| TW | 200950569 | 12/2009 |
| TW | 201029481 | 8/2010 |
| WO | WO0073204 | 12/2000 |
| WO | WO2004012932 | 2/2004 |
| WO | WO2005102924 | 11/2005 |
| WO | WO2005120130 | 12/2005 |
| WO | WO2007043837 | 4/2007 |
| WO | WO2007049496 | 5/2007 |
| WO | WO2007052928 | 5/2007 |
| WO | WO2007099975 | 9/2007 |
| WO | WO2007111107 | 10/2007 |
| WO | WO2008/029451 | 3/2008 |
| WO | WO 2008/139117 A1 * | 11/2008 |

OTHER PUBLICATIONS

Ozawa, JP 07-282961 English machine translation, Oct. 27, 1995.*

Lin Xiao et al., "Flexible, stretchable, transparent carbon nanotube thin film loudspeakers" vol. 8, No. 12, pp. 4539-4545 ,2008.

Amos, S.W.; "Principles of Transistor Circuits"; 2000; Newnes-Butterworth-Heinemann; 9th ed.;p. 114.

Chen, Huxiong; Diebold, Gerald, "Chemical Generation of Acoustic Waves: A Giant Photoacoustic Effect", Nov. 10, 1995, Science, vol. 270, pp. 963-966.

Kaili Jiang, Qunqing Li, Shoushan Fan, Spinning continuous carbon nanotube yarns, Nature, Oct. 24, 2002, pp. 801, vol. 419.

Swift Gregory W., Thermoacoustic Engines and Refrigerators, Physics Today, Jul. 1995, pp. 22-28, vol. 48.

Lin Xiao, Zhuo Chen, Chen Feng, Liang Liu et al, Flexible, Stretchable, Transparent Carbon Nanotube Thin Film Loudspeakers, Nano Letters, 2008, pp. 4539-4545, vol. 8, No. 12, US.

H.D. Arnold, I.B. Crandall, The Thermophone as a Precision Source of Sound, Physical Review, 1917, pp. 22-38, vol. 10.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Braun Ferdinand, Notiz uber Thermophonie, Ann. Der Physik, Apr. 1898, pp. 358-360, vol. 65.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Edward C. Wente, The Thermophone, Physical Review, 1922, pp. 333-345, vol. 19.

http://www.physorg.com/news123167268.html.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

William Henry Preece, On Some Thermal Effects of Electric Currents, Proceedings of the Royal Society of London, 1879-1880, pp. 408-411, vol. 30.

J.J.Hopfield, Spectra of Hydrogen, Nitrogen and Oxygen in the Extreme Ultraviolet, Physical Review, 1922, pp. 573-588, vol. 20.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

W. Yi, L.Lu, Zhang Dianlin et al., Linear Specific Heat of Carbon Nanotubes, Physical Review B, Apr. 1, 1999, vol. 59, No. 14, R9015-9018.

Zhuangchun Wu, Zhihong Chen, Xu Du et al.,Transparent, Conductive Carbon Nanotube Films, Science, Aug. 27, 2004, pp. 1273-1276, vol. 305.

Frank P. Incropera, David P. Dewitt et al., Fundamentals of Heat and Mass Transfer, 6th ed., 2007, pp. A-5, Wiley:Asia.

Strutt John William, Rayleigh Baron, The Theory of Sound, 1926, pp. 226-235, vol. 2.

P. De Lange, On Thermophones, Proceedings of the Royal Society of London. Series A, Apr. 1, 1915, pp. 239-241, vol. 91, No. 628.

Lee et al., Photosensitization of nonlinear scattering and photoacoustic emission from single-walled carbon nanotubes, Applied Physics Letters, 13, Mar. 2008, 92, 103122.

Silvanus P. Thompson, The Photophone, Nature, 23, Sep. 1880, vol. XXII, No. 569, pp. 481.

Alexander Graham Bell, Selenium and the Photophone, Nature, Sep. 23, 1880, pp. 500-503.

P.M. Ajayan et al., "Nanotubes in a flash-Ignition and reconstruction", Science, vol. 296, pp. 705, Apr. 26, 2002.

F.Kontomichos et al., "A thermoacoustic device for sound reproduction", acoustics 08 Paris, pp. 4349-4353, Jun. 29-Jul. 4, 2008.

F. Kontomichos et al ., "A thermoacoustic device for sound reproduction", acoustics 08' Paris, Jun. 29-Jul. 4, 2008.

* cited by examiner

ROOM HEATING DEVICE CAPABLE OF SIMULTANEOUSLY PRODUCING SOUND WAVES

RELATED APPLICATIONS

This application claims all benefits accruing under 35 U.S.C. §119 from China Patent Application No. 200910108045.X, filed on Jun. 9, 2009 in the China Intellectual Property Office, the disclosure of which is incorporated herein by reference.

BACKGROUND

1. Technical Field

The present disclosure relates to a room heating device. Specifically, the present disclosure relates to a room heating device capable of simultaneously producing sound waves.

2. Description of Related Art

It is common to install electrically powered room heating devices in the walls, floor, or ceiling of a room in order to provide a controllable means of heating the room. Generally, a conventional room heating device is simply an electrical resistor, and works on the principle of Joule heating: an electric current through a resistor converts electrical energy into heat energy. However, the conventional room heating device usually only has the single function of converting electrical energy into heat, thereby limiting the versatility of the room heating device.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments.

DETAILED DESCRIPTION OF EXEMPLARY EMBODIMENTS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
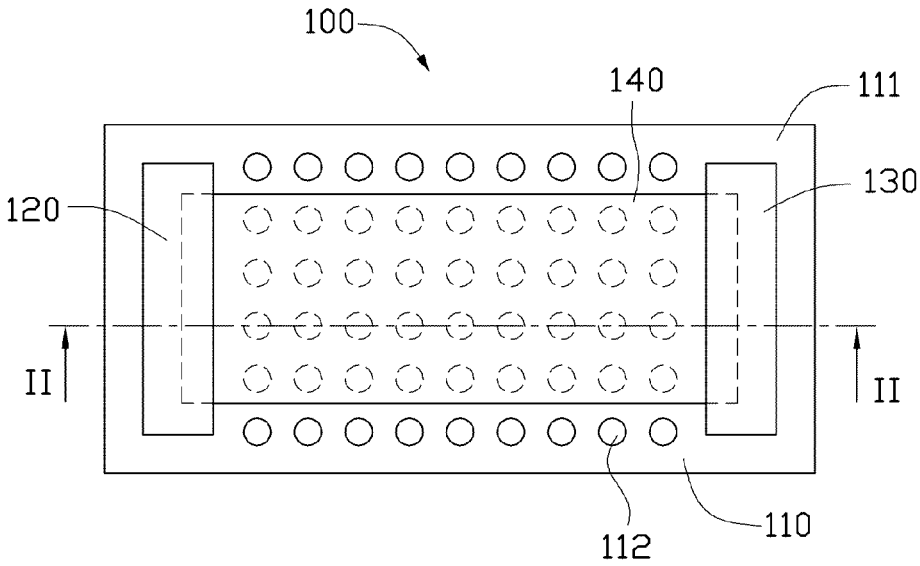
FIG. 1 is a schematic structural view of one embodiment of a room heating device.
Figure 2:
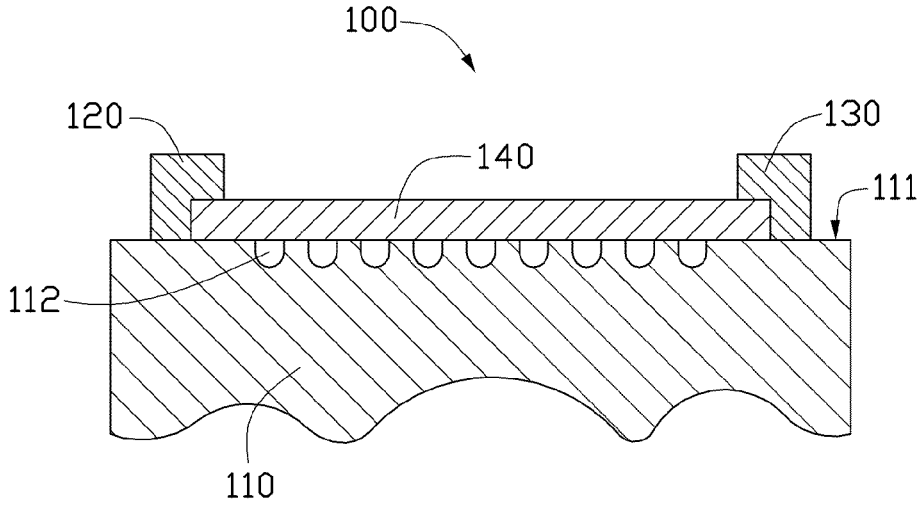
FIG. 2 is a cross-sectional view of the room heating device of FIG. 1, taken along line II-II of FIG. 1.

One embodiment of a room heating device 100 is illustrated in FIGS. 1-2. The room heating device 100 is installed on a supporting body 110, which can be walls, floors, ceiling, columns, or other surfaces of a room. The room heating device 100 comprises a first electrode 120, a second electrode 130, and a thermoacoustic element 140. The first electrode

120 and the second electrode 130 electrically connect to the thermoacoustic element 140. The detailed structure of the room heating device 100 will be described in the following text.

In this embodiment, the supporting body 110 has a substantially flat surface 111. The surface 111 directly faces the thermoacoustic element 140. A plurality of small blind holes 112 can be defined in the surface 111. The blind holes 112 can increase the contact area between the thermoacoustic element 140 and ambient air. Alternatively, the blind holes 112 can be replaced by a plurality of through holes, if desired, to heat two adjacent rooms.

The first electrode 120 and the second electrode 130 are made of electrical conductive materials such as metal, conductive polymers, carbon nanotubes, or indium tin oxide (ITO). The first electrode 120 and the second electrode 130 are located at opposite sides of the thermoacoustic element 140, respectively. As shown in FIG. 1, the thermoacoustic element 140 has a rectangular shape, and the first electrode 120 and the second electrode 130 contact with opposite ends of the thermoacoustic element 140, respectively. The first electrode 120 and the second electrode 130 are used to receive electrical signals and transfer the received electrical signals to the thermoacoustic element 140, which produces heat and sound waves simultaneously.

The thermoacoustic element 140 can be directly installed on the surface 111 as shown in FIG. 2. The thermoacoustic element 140 has a low heat capacity per unit area that can realize "electrical-thermal-sound" conversion in addition to producing heat. The thermoacoustic element 140 can have a large specific surface area for causing the pressure oscillation in the surrounding medium by the temperature waves generated by the thermoacoustic element 140. The heat capacity per unit area of the thermoacoustic element 140 can be less than $2\times10^{-4}$ J/cm$^2$*K. In one embodiment, the heat capacity per unit area of the thermoacoustic element 140 is less than or equal to $1.7\times10^{-6}$ J/cm$^2$*K. In another embodiment, the thermoacoustic element 140 can have a freestanding structure and does not require the use of structural support. The term "freestanding" includes, but is not limited to, a structure that does not have to be supported by a substrate and can sustain its own weight when hoisted by a portion thereof without any significant damage to its structural integrity. The suspended part of the structure will have more sufficient contact with the surrounding medium (e.g., air) to achieve heat exchange with the surrounding medium from both sides thereof. As shown in FIG. 2, parts of the thermoacoustic element 140 corresponding to the blind holes 112 are suspended parts. The suspended parts of the thermoacoustic element 140 have more contact with the surrounding medium (e.g., air), thus having greater heat exchange with the surrounding medium.

Figure 6:
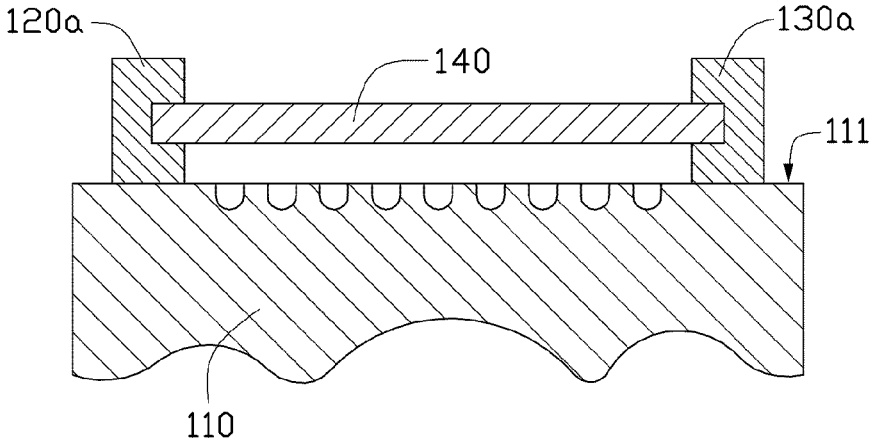
FIG. 6 is a schematic cross-sectional view of still yet another embodiment of a room heating device.

Alternatively, the thermoacoustic element 140 can be indirectly installed on the surface 111 via the first electrode 120*a* and the second electrode 130*a* as shown in FIG. 6. The first electrode 120*a* and the second electrode 130*a* are disposed on the surface 111 and spaced from each other. The thermoacoustic element 140 is secured on the first electrode 120*a* and the second electrode 130*a* via adhesive or the like, such that the thermoacoustic element 140 is hung above the surface 111.

In one embodiment, the thermoacoustic element 140 includes a carbon nanotube structure. The carbon nanotube structure can include a plurality of carbon nanotubes uniformly distributed therein and combined by van der Waals attraction force therebetween. It is noteworthy, that the carbon nanotube structure must include metallic carbon nanotubes. The carbon nanotubes in the carbon nanotube structure can be selected from single-walled, double-walled, and/or multi-walled carbon nanotubes. Diameters of the single-walled carbon nanotubes range from about 0.5 nanometers to about 50 nanometers. Diameters of the double-walled carbon nanotubes range from about 1 nanometer to about 50 nanometers. Diameters of the multi-walled carbon nanotubes range from about 1.5 nanometers to about 50 nanometers. The carbon nanotubes in the carbon nanotube structure can be orderly or disorderly arranged. The term 'disordered carbon nanotube structure' includes, but is not limited to, a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes, but is not limited to, a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). The carbon nanotube structure can be a carbon nanotube film structure, which can include at least one carbon nanotube film. The carbon nanotube structure can also be at least one linear carbon nanotube structure. The carbon nanotube structure can also be a combination of the carbon nanotube film structure and the linear carbon nanotube structure.

In one embodiment, the linear carbon nanotube structure can include one or more carbon nanotube wires. The length of the carbon nanotube wire can be set as desired. A diameter of the carbon nanotube wire can be from about 0.5 nm to about 100 μm. The carbon nanotube wires can be parallel to each other to form a bundle-like structure or twisted with each other to form a twisted structure. The carbon nanotube wire can be an untwisted carbon nanotube wire or a twisted carbon nanotube wire. An untwisted carbon nanotube wire is formed by treating a carbon nanotube film with an organic solvent. The untwisted carbon nanotube wire includes a plurality of successive carbon nanotubes, which are substantially oriented along the linear direction of the untwisted carbon nanotube wire and joined end-to-end by van der Waals attraction force therebetween. A twisted carbon nanotube wire is formed by twisting a carbon nanotube film by using a mechanical force. The twisted carbon nanotube wire includes a plurality of carbon nanotubes oriented around an axial direction of the twisted carbon nanotube wire. An example of the untwisted carbon nanotube wire and a method for manufacturing the same has been taught by US Patent Application Pub. No. US 2007/0166223. The carbon nanotube structure may include a plurality of carbon nanotube wire structures, which can be paralleled with each other, crossed with each other, weaved together, or twisted with each other.

Figure 3:
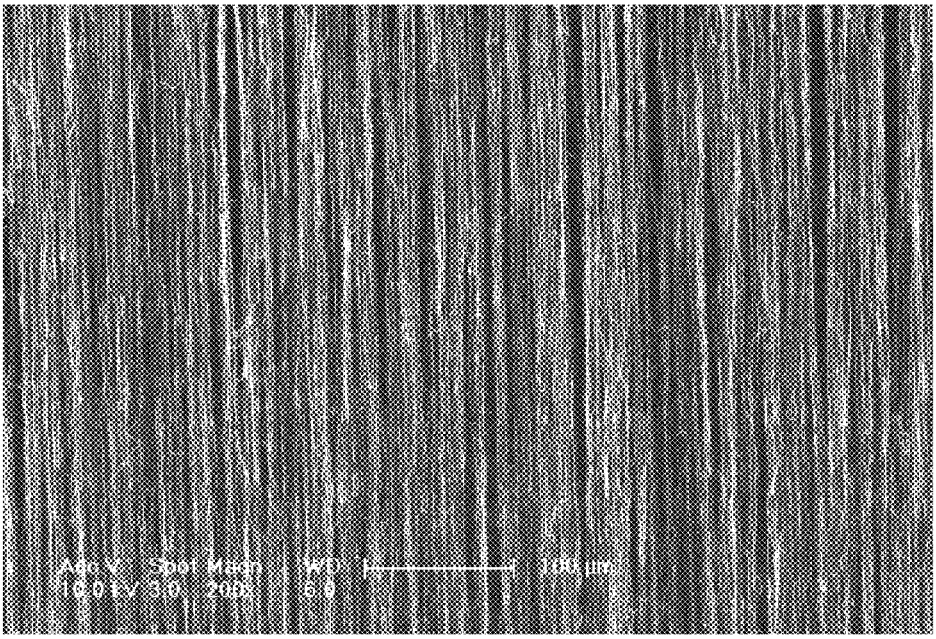
FIG. 3 shows a Scanning Electron Microscope (SEM) image of one embodiment of a carbon nanotube film used in the room heating device of FIG. 2 as a thermoacoustic element.

In one embodiment, the carbon nanotube film can be drawn from a carbon nanotube array, to obtain a drawn carbon nanotube film. Examples of drawn carbon nanotube film are taught by U.S. Pat. No. 7,045,108 to Jiang et al., and WO 2007015710 to Zhang et al. Referring to FIG. 3, the drawn carbon nanotube film includes a plurality of successive and oriented carbon nanotubes joined end-to-end by van der Waals attraction force. The drawn carbon nanotube film is a freestanding film. The carbon nanotubes in the drawn carbon nanotube film are oriented along a preferred orientation. The thickness of the carbon nanotube film can range from about 0.5 nm to about 100 μm. The carbon nanotube film can have a heat capacity per unit area less than or equal to $1\times10^{-6}$ J/cm$^2$*K. If the carbon nanotube film has a small width or area, the carbon nanotube structure can comprise two or more coplanar carbon nanotube films covered on the surface 111 of the supporting body 110. If the carbon nanotube film has a large width or area, the carbon nanotube structure can comprise one carbon nanotube film covered on the surface 111 of the supporting body 110. In some embodiments, the carbon nanotube films can be adhered directly to the surface 111 of the supporting body 110, because some of the carbon nanotube structures have large specific surface area and are adhesive in nature. In some embodiments, the carbon nanotube film consists of a plurality of successive and oriented carbon nanotubes joined end-to-end by van der Waals attraction force.

In other embodiments, the carbon nanotube structure can include two or more carbon nanotube films stacked one upon another. The carbon nanotube structure can have a thickness ranging from about 0.5 nm to about 1 mm. An angle between the aligned directions of the carbon nanotubes in the two adjacent carbon nanotube films can range from 0 degrees to about 90 degrees. Adjacent carbon nanotube films can only be combined by the van der Waals attraction force therebetween without the need of an additional adhesive.

Additionally, the number of the layers of the carbon nanotube films is not limited so long as a large enough specific surface area (e.g., above 30 m$^2$/g) can be maintained to achieve an acceptable acoustic volume. As the stacked number of the carbon nanotube films increases, the thickness of the carbon nanotube structure will increase. As the specific surface area of the carbon nanotube structure decreases, the heat capacity will increase. However, if the thickness of the carbon nanotube structure is too thin, the mechanical strength of the carbon nanotube structure will weaken, and the durability will decrease. In one embodiment, the carbon nanotube structure has four layers of stacked carbon nanotube films and has a thickness ranging from about 40 nm to about 100 μm. The angle between the aligned directions of the carbon nanotubes in the two adjacent carbon nanotube films is about 0 degrees. As shown in FIG. 2, the carbon nanotube structure is disposed on the surface 111 of the supporting body 110, and covers the blind holes 112. The axial direction of the carbon nanotubes of the carbon nanotube structure is substantially parallel to a direction from the first electrode 120 towards the second electrode 130. The first electrode 120 and the second electrode 130 are approximately uniformly-spaced and approximately parallel to each other, so that the carbon nanotube structure has an approximately uniform resistance distribution.

During operation of the room heating device 100 to heat a room, outer electrical signals are first transferred to the thermoacoustic element 140 via the first electrode 120 and the second electrode 130. When the outer electrical signals are applied to the carbon nanotube structure of the thermoacoustic element 140, heating is produced in the carbon nanotube structure according to the variations of the outer electrical signals. The carbon nanotube structure transfers heat to the medium in response to the signal, thus, the room can be quickly heated. At the same time, the heating of the medium causes thermal expansion of the medium. It is the cycle of relative heating that result in sound wave generation. This is known as the thermoacoustic effect.

Figure 4:
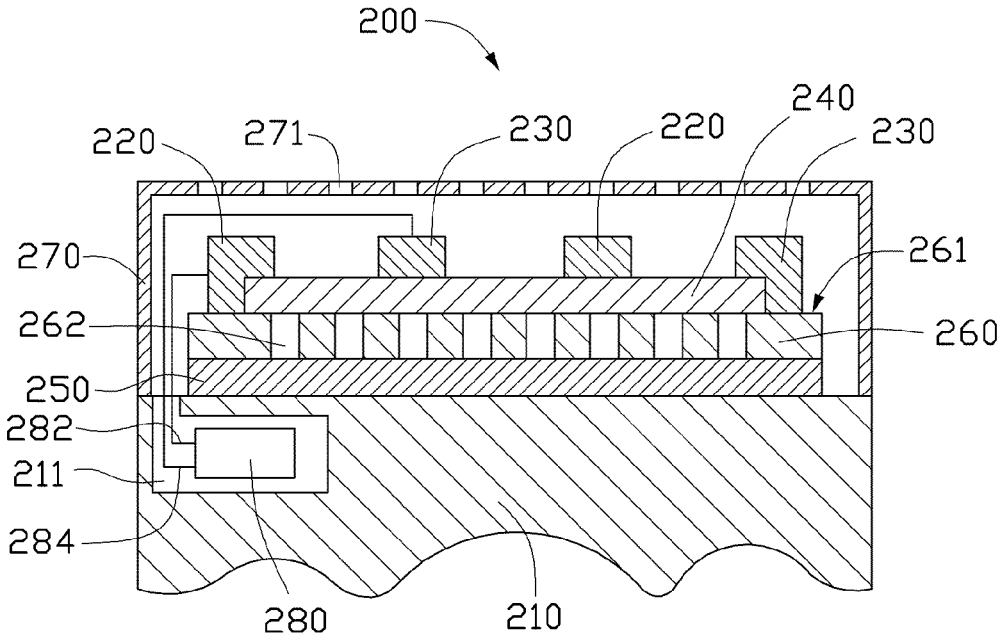
FIG. 4 is a schematic cross-sectional view of another embodiment a room heating device of one embodiment.

Referring to the embodiment shown in FIG. 4, a room heating device 200 comprises a plurality of first electrodes 220, a plurality of second electrodes 230, a thermoacoustic element 240, a reflection element 250, an insulating layer 260, a protection structure 270, and a power amplifier 280.

The room heating device 200 is installed on a supporting body 210, which can be walls, floors, ceiling, columns, or other surfaces of a room. A receiving space 211 is defined inside of the supporting body 210. The receiving space 211 is used to install the power amplifier 280 therein.

The reflection element 250 is disposed on a top surface of the supporting body 210. The reflection element 250 is used to reflect the thermal radiation emitted by the thermoacoustic element 240 towards a direction away from the supporting body 210. Thus, the amount of thermal radiation absorbed by the supporting body 210 can be reduced. The reflection element 250 can be a thermal reflecting plate installed on the supporting body 210 or a thermal reflecting layer spread on the supporting body 210. The thermal reflecting plate and the thermal reflecting layer can be made of metal, metallic compound, alloy, glass, ceramics, polymer, or other composite materials. The thermal reflecting plate and the thermal reflecting layer can be made of chrome, titanium, zinc, aluminum, gold, silver, Zn—Al Alloy, glass powder, polymer particles, or a coating including aluminum oxide. Alternatively, the reflection element 250 can also be a plate coated with thermal reflecting materials or a plate having a thermal reflecting surface. Further, in addition to reflecting the thermal radiation emitted by the thermoacoustic element 240, the reflection element 250 can also reflect the sound waves generated by the thermoacoustic element 240, thereby enhancing acoustic performance of the thermoacoustic element 240.

The insulating layer 260 is disposed on a top surface of the reflection element 250. The insulating layer 260 is used to insulate the thermoacoustic element 240 from the reflection element 250. The insulating layer 260 can be adhered to the top surface of the reflection element 250. The insulating layer 260 can be made of heat-resistant insulating materials such as glass, treated wood, stone, concrete, metal coated with insulating material, ceramics, or polymer such as polyimide (PI), polyvinylidene fluoride (PVDF), and polytetrafluoroethylene (PTFE). A plurality of through holes 262 is defined through the insulating layer 260. The presence of the through holes 262 can reduce the contact area between the insulating layer 260 and the thermoacoustic element 240. The through holes 262 can also increase the contact area between the thermoacoustic element 240 and ambient air. Alternatively, the through holes 262 can be replaced by a plurality of blind holes similar to that of the room heating device 100.

The thermoacoustic element 240 is disposed on a top surface 261 of the insulating layer 260. The thermoacoustic element 240 is similar to the thermoacoustic element 140. The first electrodes 220 and the second electrodes 230 are uniformly distributed on a top surface of the thermoacoustic element 240 and are spaced from each other. The first electrodes 220 are electrically connected in series and the second electrodes 230 are electrically connected in series. The first electrodes 220 and the second electrodes 230 alternatively arrange and divide the thermoacoustic element 240 into a plurality of subparts. Each of the subparts is located between one of the first electrodes 220 and its adjacent second electrode 230. The subparts are parallelly connected to reduce the electrical resistance of the thermoacoustic element 240.

The protection structure 270 can be made of heat-resisting materials, such as metal, glass, treated wood, and polytetrafluoroethylene (PTFE). The protection structure 270 is a net structure, such as a metallic mesh, which has a plurality of apertures 271 defined therethrough. The protection structure 270 parallelly mounts on the supporting body 210. The protection structure 270 is spaced from top surfaces of the thermoacoustic element 240, the first electrodes 220 and the second electrodes 230. The protection structure 270 is mainly to protect the thermoacoustic element 240 from being damaged or destroyed. The presence of the apertures 271 can facilitate the transmission of heat and sound wave.

The power amplifier 280 is installed in the receiving space 211. The power amplifier 280 electrically connects to a signal output of a signal device (not shown). In detail, the power amplifier 280 includes a first output 282 and a second output 284 and one input (not shown). The input of the power amplifier 280 electrically connects to the signal device. The first output 282 electrically connects to the first electrodes 220, and the second output 284 electrically connects to the second electrodes 230. The power amplifier 280 is configured for amplifying the power of the signals outputted from the signal device and sending the amplified signals to the thermoacoustic element 240.

Figure 5:
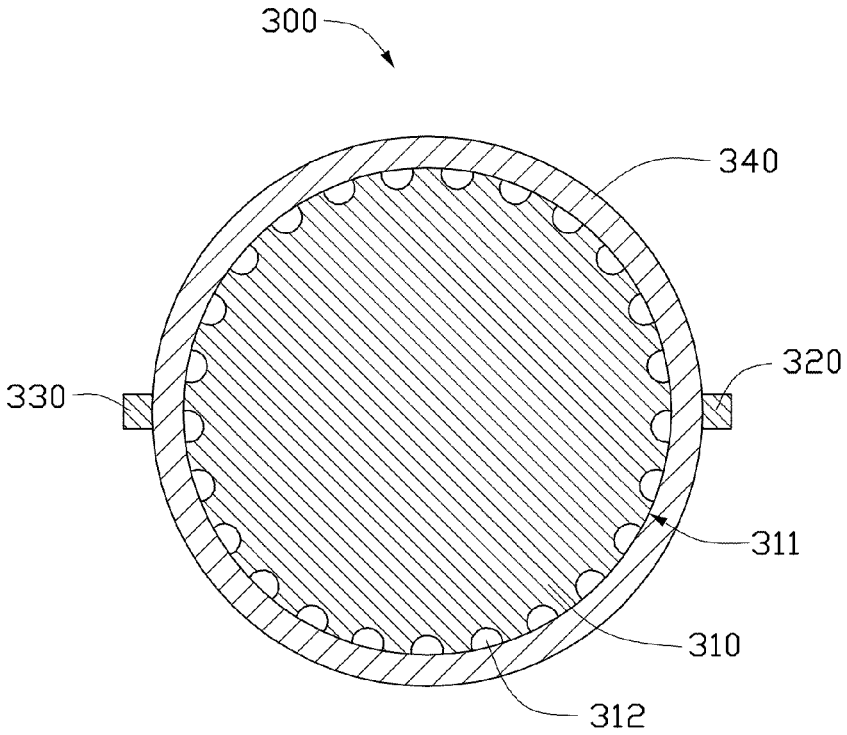
FIG. 5 is a schematic cross-sectional view of a room heating device of yet another embodiment.

Referring to the embodiment shown in FIG. 5, a room heating device 300 is similar to the room heating device 100. The room heating device 300 also comprises a first electrode 320, a second electrode 330 and a thermoacoustic element 340. The main difference between the room heating device 300 and the room heating device 100 is that the thermoacoustic element 340 is tube-shaped and is installed on a column-shaped supporting body 310. The thermoacoustic element 340 surrounds a periphery 311 of the column-shaped supporting bodies 310. A plurality of blind holes 312 are defined on the periphery 311. In one embodiment, each of the first electrodes 320 and the second electrode 330 is line shaped and extends along an axis direction of the column-shaped supporting body 310. When viewing the cross section of the room heating device 300 shown in FIG. 5, the first electrode 320 and the second electrode 330 are arranged in a line, which passes through a centre of the column-shaped supporting body 310 or the thermoacoustic element 340.

When the room heating devices is operating, outer electrical signals transfer to the thermoacoustic elements. The thermoacoustic elements can produce heat and sound waves simultaneously. Such a design can increase the versatility and utility of the room heating devices. Further, a user can estimate the working status of the thermoacoustic elements by hearing the sound wave generated by the thermoacoustic elements, without having to walk close to the thermoacoustic elements. Moreover, a desired sound effect can be achieved by arranging the room heating devices at different places of a room.

Finally, it is to be understood that the above-described embodiments are intended to illustrate rather than limit the present disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A room heating device comprising:

a supporting body, wherein the supporting body has a surface, and a plurality of first holes are defined in the surface;

a thermoacoustic element disposed on the surface of the supporting body and covers the plurality of first holes, wherein the thermoacoustic element have a heat capacity per unit area less than or equal to $1\times10^{-6}$ J/cm$^2$*K, and the thermoacoustic element is capable of producing heat and sound waves simultaneously;

a first electrode connected to the thermoacoustic element; and a second electrode connected to the thermoacoustic element, and spaced apart from the first electrode.

2. The heating device of claim 1, wherein the thermoacoustic element is directly disposed on the surface of the supporting body.

3. The heating device of claim 1, wherein the first electrode and the second electrode are disposed on a surface of the supporting body, and the thermoacoustic element is secured on the first electrode and the second electrode, the thermoacoustic element is hung above the surface of the supporting body.

4. The heating device of claim 1, further comprising a reflection element disposed on a surface of the supporting body, wherein the thermoacoustic element is disposed on the reflection element.

5. The heating device of claim 4, further comprising an insulating layer disposed on the reflection element, wherein the thermoacoustic element is directly disposed on the insulating layer.

6. The heating device of claim 5, wherein a plurality of second holes is defined in the insulating layer, and the thermoacoustic element covers the second holes.

7. The heating device of claim 6, wherein the second holes extend through the insulating layer and the thermoacoustic element directly faces the reflection element via the holes.

8. The heating device of claim 1, further comprising a power amplifier, wherein a receiving space is defined inside of the supporting body and the power amplifier is installed in the receiving space.

9. The heating device of claim 1, further comprising a protection structure parallel-mounted on the supporting body and the protection structure is spaced from top surfaces of the thermoacoustic element, the first electrode and the second electrode.

10. The heating device of claim 9, wherein the protection structure is a metallic mesh.

11. The heating device of claim 1, wherein the thermoacoustic element comprises a carbon nanotube film structure comprising at least one carbon nanotube film, a linear carbon nanotube structure, or a combination of the carbon nanotube film structure and the linear carbon nanotube structure.

12. The heating device of claim 1, wherein the thermoacoustic element is a carbon nanotube film structure comprising at least one carbon nanotube film, a linear carbon nanotube structure, or a combination of the carbon nanotube film structure and the linear carbon nanotube structure.

13. The heating device of claim 12, wherein the at least one carbon nanotube film consists of a plurality of successive and oriented carbon nanotubes joined end-to-end by van der Waals attractive force therebetween.

14. The heating device of claim 12, wherein the carbon nanotube structure includes a plurality of successive and oriented carbon nanotubes joined end-to-end by van der Waals attractive force, and an axial direction of the carbon nanotubes of the carbon nanotube structure is substantially parallel to a direction from the first electrode towards the second electrode.

15. The heating device of claim 1, wherein the thermoacoustic element is tube-shaped and the supporting body is column-shaped, the thermoacoustic element surrounds a periphery of the supporting body.

16. The heating device of claim 15, wherein each of the first electrode and the second electrode is line shaped and extends along an axis direction of the supporting body.

17. The heating device of claim 1, wherein the plurality of first holes are through holes extending through the supporting body.

* * * * *